United States Patent [19]

Coble

[11] Patent Number: 4,611,791

[45] **Date of Patent: * Sep. 16, 1986**

[54] DIFFUSER SYSTEM FOR ANNEALING FURNACE WITH WATER COOLED BASE

[76] Inventor: Gary L. Coble, 12065 Greenwick Rd., Homerville, Ohio 44234

[ * ] Notice: The portion of the term of this patent subsequent to May 14, 2002 has been disclaimed.

[21] Appl. No.: 732,400

[22] Filed: May 9, 1985

Related U.S. Application Data

[63] Continuation-in-part of Ser. No. 456,823, Jan. 10, 1983, Pat. No. 4,516,758.

[51] Int. Cl.[4] ..... F27B 5/06

[52] U.S. Cl. ..... 266/263; 266/264; 432/260

[58] Field of Search ..... 432/254.1, 254.2, 260; 266/262–264, 274

[56] References Cited

U.S. PATENT DOCUMENTS 4,310,302 1/1982 Thekdi et al. ..... 432/205

4,516,758 5/1985 Coble ..... 266/263

*Primary Examiner*—Christopher W. Brody

*Attorney, Agent, or Firm*—David A. Burge

[57] ABSTRACT

A convection diffuser and charge support system for an annealing furnace utilizes a diffuser base assembly that includes a vane-carrying center casting which underlies a charge support plate, and which is perimetrically surrounded by a pair of outer and inner cooling rings. The components of the diffuser base assembly cooperate to define an array of horizontally extending gas circulation passages that are shielded from above by the charge support plate. The horizontal passages extend among a plurality of upstanding heat exchange fins that are carried by the inner cooling ring, and terminate in upwardly extending outer end regions that are defined by grooves formed in the outer cooling ring. A centrifugal fan draws hot gases through a central opening in the charge support plate and conveys the gases radially outwardly through the horizontally extending gas flow passages. The gases flow outwardly through the horizontal passages, among the fins of the inner cooling ring, and are diverted upwardly by the grooves of the outer cooling ring for movement along generally helical flow paths about a charge of material being annealed. The outer cooling ring is provided with a depending, perimetrically extending skirt. In an annealing process, cooling of the hot gases within the furnace enclosure is carried out in a two stage procedure that is initiated sufficiently gradually to avoid collapse of the positive pressure atmosphere within the furnace enclosure.

13 Claims, 15 Drawing Figures

DIFFUSER SYSTEM FOR ANNEALING FURNACE WITH WATER COOLED BASE

CROSS-REFERENCED TO RELATED APPLICATION

The present application is a continuation-in-part of co-pending application Ser. No. 456,823, filed Jan. 10, 1983, issued May 14, 1985, as U.S. Pat. No. 4,516,758, entitled DIFFUSER SYSTEM FOR ANNEALING FURNACE, hereinafter referred to as the "Diffuser System Patent," the disclosure of which is incorporated herein by reference.

BACKGROUND OF THE INVENTION

1. Field of the Invention

The present invention relates generally to the heat treating process known as annealing, and, more particularly, to a convection diffuser and charge support system with fluid cooled base components for use in an annealing furnace, and to methods for carrying out an annealing process by operating a water cooled convection diffuser and charge support system in a particularly advantageous manner to provide a controlled cooling of gases that are circulated within the closed environment of the annealing furnace during an annealing process without causing collapse of the positive pressure atmosphere of the furnace.

2. Prior Art

Annealing is a heat treatment process whereby a charge of material is heated to and held at an elevated temperature for a sufficient length of time to assure that metastable conditions in the material, such as frozen-in strains, dislocations, vacancies, and the like are permitted to achieve thermodynamic equilibrium. With ferrous materials, the term "annealing" is usually used in the sense of a "full" annealing process which involves a change of phase, whereby the metal is heated into the austentic region, and thereafter cooled back to ambient temperature to develop a softened structure of pearlite and ferrite within the metal.

Where the charge of ferrous material being annealed has been cold-worked, the annealing process is used to soften the material to relieve such hardness as has been induced during cold working. Cold-working tends to increase the dislocation density of a metal manyfold. By way of example, a cold-worked piece of metal may have a dislocation density that is $10^6$ greater than that of an unworked specimen of the same material. Since dislocations within cold-worked metal are surrounded by strain fields, the greater the number of dislocations, the greater is the magnitude of the "free energy" which is stored in these strain fields and which can be released during annealing to furnish a driving force that will assist in bringing the dislocation density back to within a desired range.

In order to properly anneal a charge of ferrous material, it is important to confine the charge within an enclosure wherein a non-oxidizing environment is maintained. The gases which define the non-oxidizing environment must be circulated within the enclosure during annealing to assure that convection heat transfer takes place efficiently to enable the annealing process to be carried out in a reasonable period of time. Similarly, during cooling of the charge, proper gas flow is important to effect convection cooling.

Where the charge of material to be annealed takes the form of a plurality of coils of rolled steel, the enclosure utilized to surround and support the charge conventionally includes an annular base structure atop which a vertical stack of the coils of steel to be annealed is supported, with the coils positioned coaxially one atop another. The enclosure also includes a generally cylindrical shroud which cooperates with the base structure to contain the stacked charge of coils and to define an enclosed environment within which hot gases of the controlled environment are caused to circulate.

In conventional practice, a fan is disposed in a centrally located chamber or hole formed through the base structure for forcing circulation of the gases of the non-oxidizing atmosphere throughout the enclosure. The conventional flow path for circulation includes a flow of gases downwardly through the stack of coils, and upwardly along the outer surfaces of the coils. Convector plates are interposed between adjacent ones of the stacked coils to provide convection flow paths for diverting some of the circulating gases between the ends of adjacent coils. The base structure on which the lowermost coil rests is provided with vanes for directing gases discharged from the fan outwardly and upwardly about the stack of coils.

While the gas circulation passages of a newly built diffuser base may provide a gas flow pattern that is relatively effective in disbursing gases throughout the enclosure, once the newly built base has been in service for several months, its flow passages often become deformed due to thermodynamically induced stress which results in creep growth that requires trimming, with the result that the passages no longer operate as intended to properly direct gas flow.

Moreover, inasmuch as the structures which define the vanes of present day diffuser bases are traditionally formed as weldments of relatively soft steel, the vanes tend to become deformed and/or broken during use, thereby further adding to the inefficiency and unpredictability of a diffuser base after it has been in use for a significant period of time. Thus, present day diffuser bases not only fail to operate efficiently and effectively over long periods of time, but also require frequent checking for structural integrity, cleaning and repair.

While proposals have been made to utilize water cooled heat exchanger equipment of various types to expedite the cooling of the heated gases that are present in an annealing furnace enclosure after a charge of metal has been heated sufficiently to anneal it, problems have arisen in efforts to implement these proposals. In many instances, the heat exchanger equipment has been found to interfere with proper flow of the gases within the furnace enclosure. In most instances, the initiation of a flow of cooling fluid through the heat exchanger equipment has been found to cause so rapid a temperature drop in the gases within the enclosure that the positive pressure atmosphere of the gases is "collapsed" such that a negative pressure results. The tendency toward creation of a negative pressure within the furnace enclosure (the pressure is "negative" in comparison to the pressure of surrounding ambient air) has the very undesirable effect of causing ambient air to be drawn into the enclosure. With the introduction of ambient air, and the oxygen it contains, deleterious effects are encured by the charge of metal being annealed.

In order to overcome the deleterious effects of an unwanted introduction of ambient air into the annealing furnace enclosure, it has been found necessary, in implementing most prior proposals for the use of water cooled heat exchanger equipment in an annealing furnace, to initiate operation of the heat exchanger equipment while the gas temperature within the furnace enclosure is sufficiently high that the resulting collapse of the positive pressure atmosphere within the furnace (and the attendant drawing of oxygen containing ambient air into the furnace enclosure) can be overcome by re-establishing a positive pressure, non-oxygen-containing atmosphere while the charge of metal being annealed is still sufficiently hot to permit that the deleterious effect that is occasioned by the action of oxygen on the metal to be treated and overcome (i.e., reversed) before the charge of metal has cooled to an extent that the deleterious effect is retained by the treated metal.

The need to "turn on" previously proposed heat exchanger equipment while the temperature within the closed environment of an annealing furnace is relatively high causes the heat exchanger equipment to be subjected to a wrenching thermal shock that significantly diminishes the life expectancy that this equipment would otherwise enjoy if it were not necessary to initiate its cooling function while the temperature within the annealing furnace enclosure is so high. Due to the enormity of the thermal shock to which the heat exchanger equipment is subjected, its construction must be significantly strengthened and enhanced to guard against shock induced failure, whereby the physical size of this equipment and the attendant extent to which the equipment interferes with the proper flow of gases within the furnace enclosure are undesirably increased, and the overall performance of the furnace suffers.

Stated in another way, the implementation of prior proposals for the use of fluid cooled heat exchange equipment in the environment of an annealing furnace has been found to encounter more problems, and problems of greater severity, than would be expected; moreover, many of these implementation efforts have been found to fail as the result of components being subjected to excessive thermal shock, and/or to be unacceptable in view of the deleterious effect that the components have on desirable operating characteristics of an annealing furnace.

3. The Referenced Diffuser System Patent

The invention of the Diffuser System Patent addresses the foregoing and other drawbacks of the prior art by providing a durable, novel and improved convection diffuser and charge support system. In preferred practice, the invention of the Diffuser System Patent utilizes charge support system components that are formed from highly durable, shock resistant nodular cast iron, with selected ones of the components incorporating cast-in-situ cooling conduits.

In accordance with the preferred practice of the invention of the Diffuser System Patent, a diffuser base, a base-encircling ring, and a plurality of charge-support convector plates are all formed as castings of a particularly durable material known as nodular iron. Nodular iron is cast iron which has been treated while in a molten state with an alloy that contains an element such as magnesium which favors the formation of spheroidal graphite when the cast iron solidifies, whereby the resulting product is more ductile and durable than normal cast iron.

The casting or castings of the diffuser base define a set of horizontally extending gas circulation passages that are shielded from above by an integrally formed overlying top wall. The top wall also serves to strengthen a plurality of upstanding gas directing vanes that are formed as integral parts of the diffuser base casting or castings, whereby there is much less tendency for deformation and breakage of the vanes. The casting or castings which form the base-encircling ring define an array of curved, upwardly opening passages that cooperate with the primary flow passages of the diffuser base to direct the gases of the non-oxidizing atmosphere along particularly advantageous, substantially helical flow paths about the periphery of the stack of coils.

By forming the base-encircling ring as a structure which is separate and apart from the diffuser base, the base and the ring are easily separated one from the other for occasional cleaning. Moreover, this feature of separability enables the primary gas flow passages formed in the diffuser base to extend almost entirely horizontally and to thereby be shielded from above by the top wall of the base to prevent debris from falling into these carefully configured passages. The passages formed in the base-encircling ring comprise, in effect, upwardly curved extensions of the horizontally extending primary flow passages formed in the base. When the diffuser base is separated from the ring, the passages of both of these structures are rendered readily accessible for cleaning and maintenance.

Other features of the invention of the Diffuser System Patent lie in the optional use of (1) one or more cast-in-situ cooling conduits provided in the base-encircling ring, and (2) a continuous, depending skirt wall that is formed as an integral part of the base-encircling ring. The cooling conduit or conduits may be utilized during the cool-down part of an annealing cycle to assist in cooling such gases as are circulated within the controlled environment. The depending skirt extends into an upwardly facing annular groove that is conventionally provided in the furnace base. The skirt engages a fibrous refractory sealant positioned in the groove and thereby assists in effecting a gas-tight seal that prevents ambient air from entering the closed controlled environment of the annealing furnace. The skirt also shields the surrounded portion of the furnace from deterioration.

SUMMARY OF THE INVENTION

The system of the present invention provides a convection diffuser and charge support system having water cooled base structure components, wherein the system incorporates improvements and refinements of features that form the subject matter of the referenced Diffuser System Patent. The system of the present invention preserves the high degree of efficiency with which the system of the referenced Diffuser System Patent circulates gases in the closed controlled environment of an annealing furnace, and yet provides an enhanced capability for cooling the gases in an accelerated but controlled manner once the heating portion of an annealing cycle has been completed.

The present invention provides a convection diffuser and charge support system having a water cooled heat exchange capability that functions without causing collapse of the positive pressure atmosphere within the furnace enclosure, whereby the water cooled components of the system (1) may be brought into operation at lower temperatures than is possible with systems embodying many prior proposals, and (2) need not be constructed to withstand the extraordinary degree of thermal shock to which heat exchanger structures of prior proposals are subjected by virtue of their need to initiate operation at relatively high temperatures.

In accordance with the preferred practice of the present invention, a charge support structure (which may take the form of either a single casting such as is described in the referenced Diffuser System Patent, or a mated arrangement of two or more castings as is described later herein) is perimetrically surrounded by a pair of outer and inner cooling rings. The outer and inner cooling rings preferably are brought into fluid cooled operation in a sequential manner when the temperature within the closed controlled environment of the annealing furnace has reached predetermined relatively low values, whereby the cooling rings are subjected to minimal thermal shock but nonetheless function quite effectively to expedite the cooling of gases in a particularly desirable manner. Features of the invention reside not only in the provision and structural arrangement of the outer and inner cooling rings, but also in preferred method of their use in an annealing process, as will be explained.

In accordance with the preferred practice of the present invention, a convection diffuser and charge support system for an annealing furnace utilizes a diffuser base assembly that is perimetrically surrounded by a pair of outer and inner cooling rings. In preferred practice, the components of the diffuser base assembly include a vane-carrying center casting which underlies a charge support plate, and which cooperate to define an array of horizontally extending gas circulation passages that are shielded from above by the charge support plate. The horizontal passages extend among a plurality of upstanding heat exchange fins that are carried by the inner cooling ring, and terminate in upwardly turned outer end regions that are defined by grooves formed in the outer cooling ring. A centrifugal fan draws hot gases through a central opening in the charge support plate and conveys the gases radially outwardly through the horizontally extending gas flow passages. The gases flow outwardly through the horizontal passages, among the fins of the inner cooling ring, and are diverted upwardly by the grooves of the outer cooling ring for movement along generally helical flow paths about a charge of material being annealed. The outer cooling ring is provided with a depending, perimetrically extending skirt. Where the charge of metal being annealed takes the form of a vertical stack of coils, convector plates are interposed between end regions of adjacent ones of the coils to provide flow paths for ducting gases therebetween, and for cooperating with the base assembly to provide an apparatus that enables a particularly advantageous type of controlled cooling to be carried out as the charge is being annealed.

Especially significant features lie in the provision and utilization of a pair of outer and inner cooling rings that perimetrically surround a centrally located charge support structure, whereby a dual staged implementation of a fluid cooled heat exchange process can be employed, with the outer ring (which is preferably formed as a bolted-together assembly of relatively heavy castings) can be gradually cooled to start the heat exchange process without causing the positive pressure atmosphere within the furnace to be collapsed, and with the inner ring being brought into cooling operation at a lower temperature whereby its relatively lightweight construction is not subjected to so great a thermal shock as is the more heavily constructed outer cooling ring.

Still other features reside in the provision of a charge support structure that includes a charge support plate which overlies a central casting, with upwardly extending vanes being formed on the central casting for cooperating with the charge support plate to define horizontally extending gas flow passages through which flows of gases are maintained by a centrally located fan; the provision on the central casting of a perimetrically extending lip formation for supporting the inner cooling ring; and the utilization of interlocking formations on the charge support plate and the central casting so that, if radial cracks develop in the charge support plate (preferably along radially extending lines of weakness that are provided in the casting that forms the charge support plate), the segments of the charge support plate will be held in place atop the central casting.

BRIEF DESCRIPTION OF THE DRAWINGS

Other features and a fuller understanding of the invention may be had by referring to the following description and claims taken in conjunction with the accompanying drawings, wherein:

DESCRIPTION OF THE PREFERRED EMBODIMENT

Figure 1:
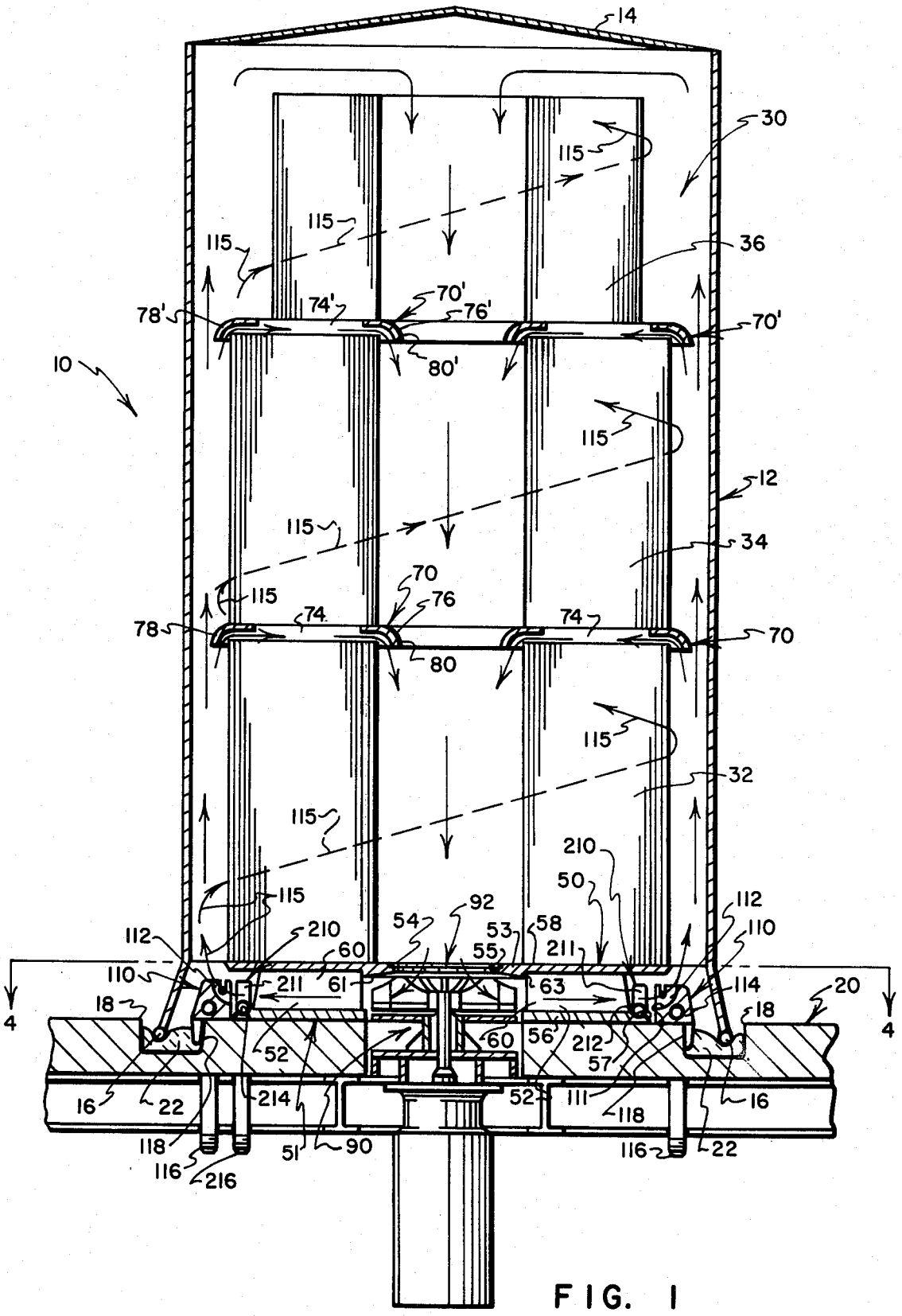
FIG. 1 is a vertical cross-sectional view of portions of a heat-treating apparatus depicting, somewhat schematically, novel and improved features of the convection diffuser and charge support system of the present invention.

Referring to FIG. 1, a heat-treating apparatus embodying features of the preferred practice of the present invention is indicated generally the numeral 10. The apparatus 10 includes a conventional, generally cylindrical enclosure 12 having a closed upper end 14 and an open lower end defined by a rim 16. The rim 16 extends into an upwardly-opening annular groove 18 defined by a conventional support structure 20. The groove 18 is provided with a seal 22 of suitable material such as ceramic fiber refractory to prevent leakage of such gases as are supplied (in a conventional manner by conduits which are not shown) to the interior of the enclosure 12 to provide a positive pressure, non-oxidizing atmosphere within the enclosure 12. Housed within the enclosure 12 is a charge 30 of material to be annealed, depicted in FIG. 1 as including a vertical stack 30 of three coils of steel 32, 34, 36.

In accordance with features of the present invention, a diffuser base and support structure of novel and improved design, indicated generally by the numeral 50, underlies and supports the lowermost coil 32. A convector plate 70 is positioned between the coils 32, 34, and an identical convector plate 70′ is positioned between the coils 34, 36.

A fan 90 having a rotary impeller 92 is disposed substantially centrally with respect to the diffuser base 50 for circulating non-oxidizing gases within the closed environment of the enclosure 12. The improved diffuser base and support structure 50 is shown somewhat schematically in FIGS. 1 and 2 as defining gas flow passages 52 which extend horizontally outwardly from the vicinity of the fan 90 to the vicinity of a pair of outer and inner cooling ring structures 110, 210. The outer cooling ring structure 110 has grooves 111 formed therein that cooperate to define curved, upwardly turned gas flow passages 112 for receiving gases that discharge radially outwardly from the passages 52 under the influence of the fan 90, and for directing these gases outwardly and upwardly along helical flow paths about the outer surfaces of the stack 30 of coils 32, 34, 36, as is indicated generally by arrows 115. The inner cooling ring structure 210 has heat exchange fins 211 that project into the paths of gases that discharge from the passages 52 for cooling these gases as they travel toward the passages 112, as will be explained.

The diffuser base 50 includes a center casting 51 that has a central opening 54 which surrounds the impeller 92 of the fan 90, and an overlying charge support plate 53 which has a relatively smaller diameter central opening 55 located atop the impeller 92 of the fan 90. The center casting 51 and the charge plate 53 cooperate to protectively shield portions of the impeller 92 of the fan 90, and to facilitate establishing efficient, directionally controlled flows of gases within the environment of the furnace enclosure 12.

Referring to FIGS. 4, 5, 10 and 11 the center casting 51 of the diffuser base 50 includes a bottom wall 56 of annular, substantially planar configuration. A perimetrically extending lip 57 projects radially outwardly along the circumference of the bottom wall 56 to define an upwardly facing ledge for receiving and supporting the inner cooling ring 210. A plurality of curved vane formations 60 extend vertically upwardly from the bottom wall 56 and are formed integrally therewith.

Figures 2, 3, 3A:
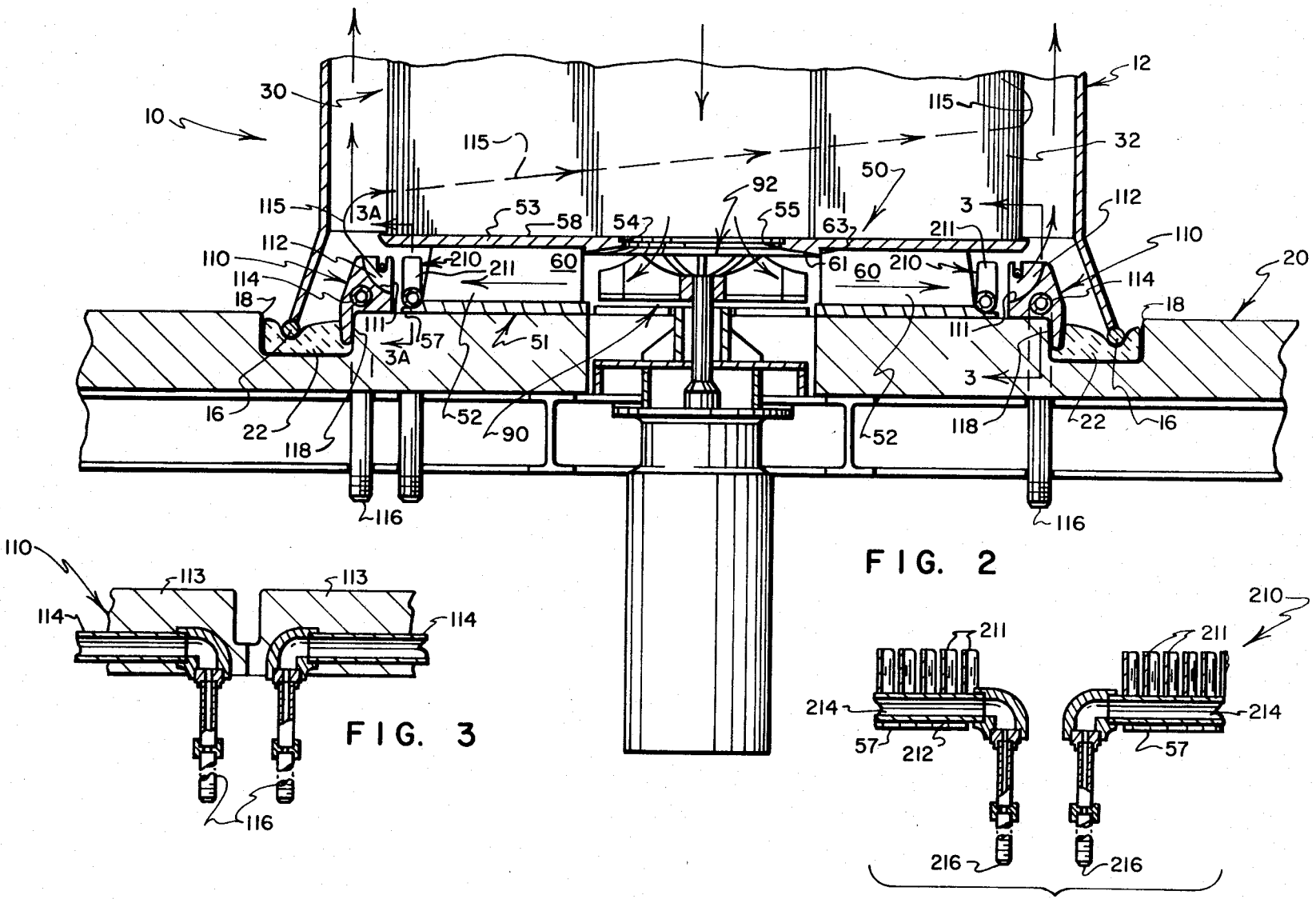
FIG. 2 is an enlargement of a lower portion of the apparatus of FIG. 1.
FIGS. 3 and 3A are sectional views of the outer and inner cooling rings, as seen from planes indicated by lines 3—3 and 3A—3A, respectively, in FIG. 2.
Figure 12:
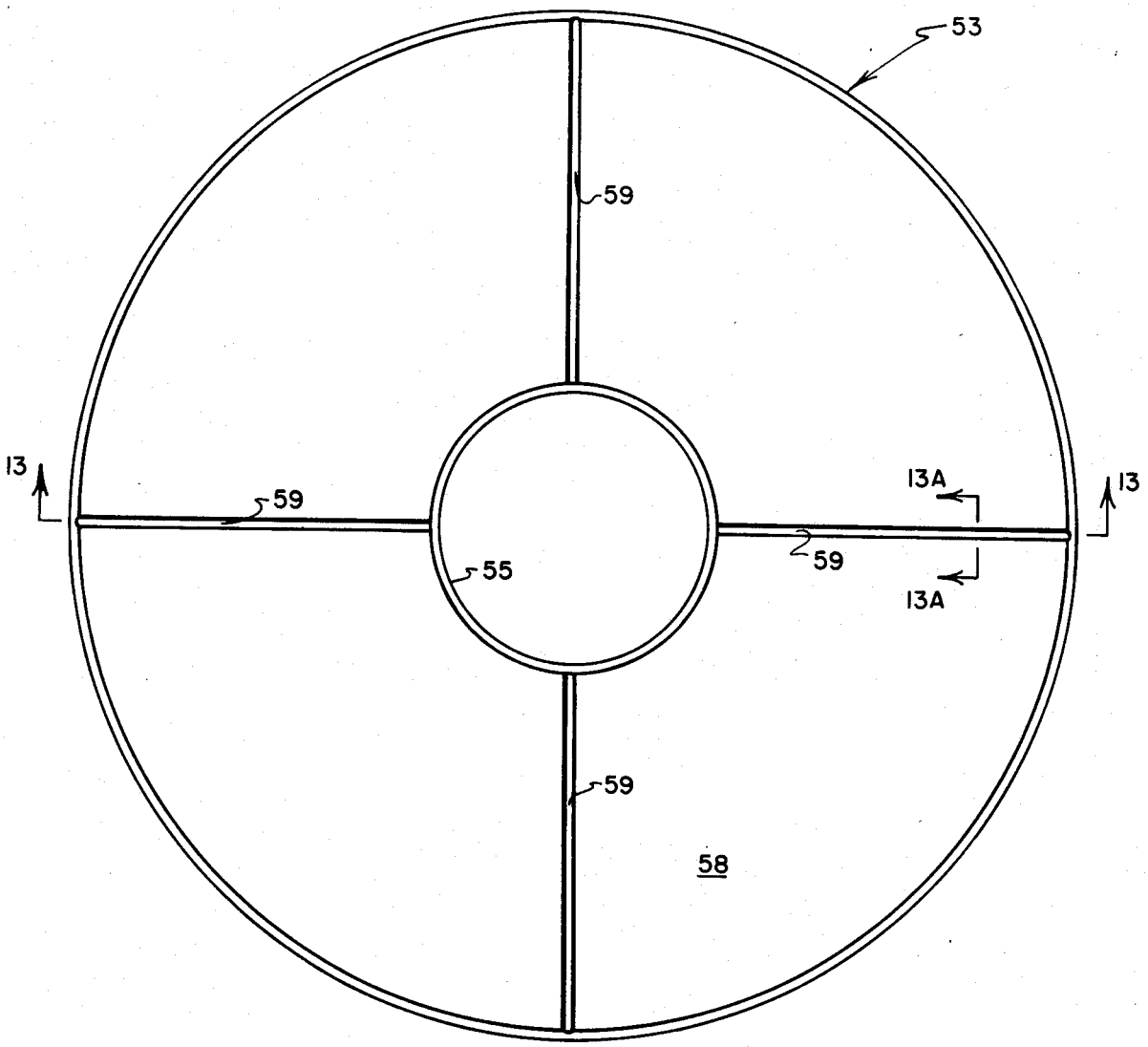
FIG. 12 is a top plan view of the charge support plate of the diffuser base assembly.
Figure 13:
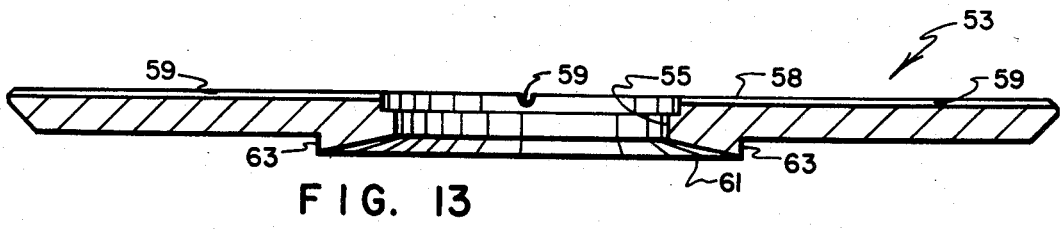
FIGS. 13 and 13A are sectional views as seen from planes indicated by lines 13—13 and 13A—13A, respectively, in FIG. 12.
Figure 13A:
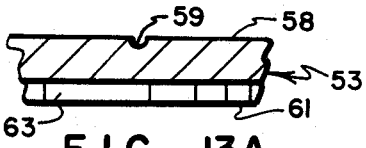
Figure 14:
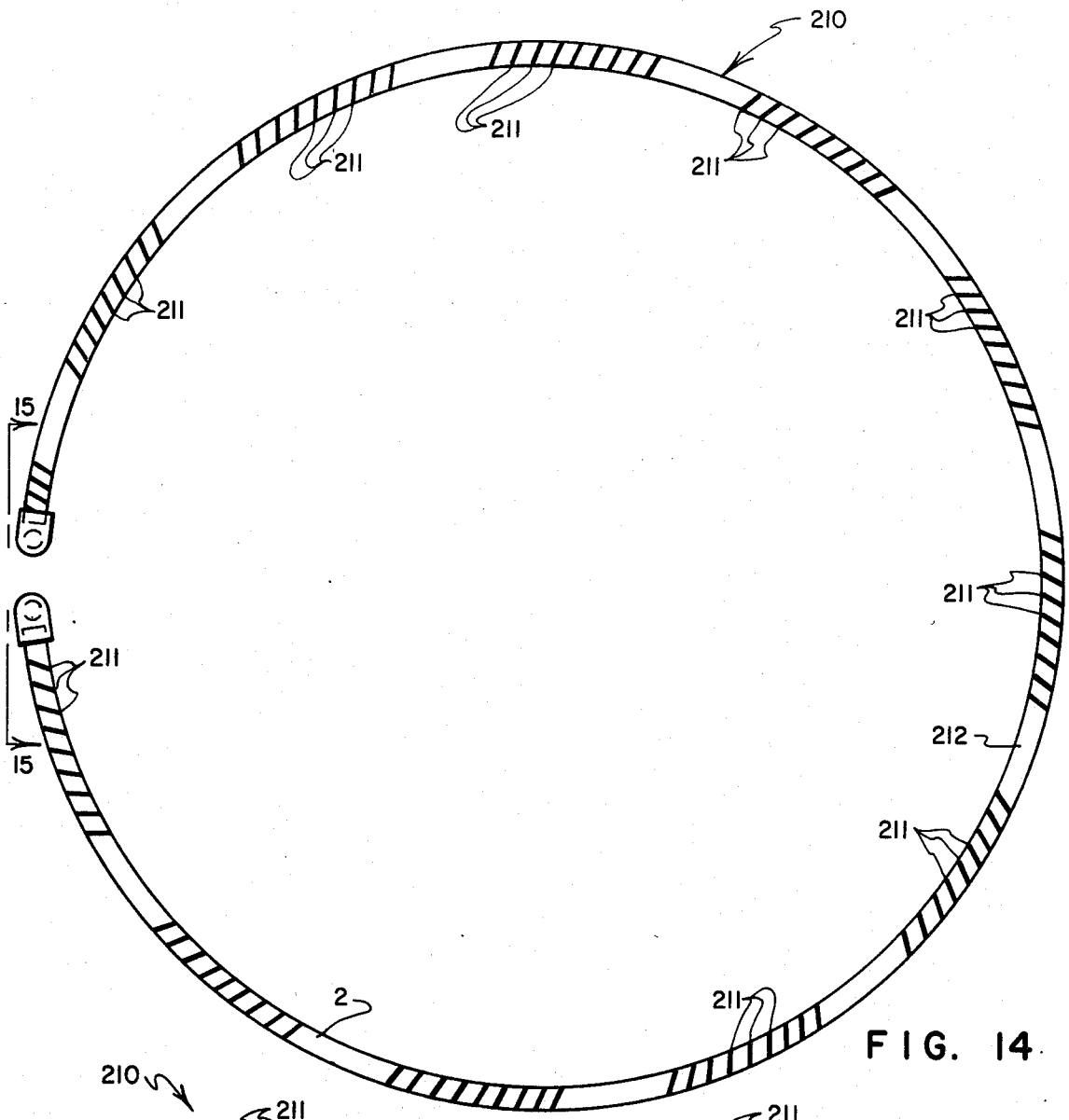
FIG. 14 is a top plan view of the inner cooling ring of the diffuser base assembly; and, FIG. 15 is a side elevational view, on an enlarged scale, of portions of the inner cooling ring, as seen from a plane indicated by a line 15—15 in FIG. 14.
Figure 15:
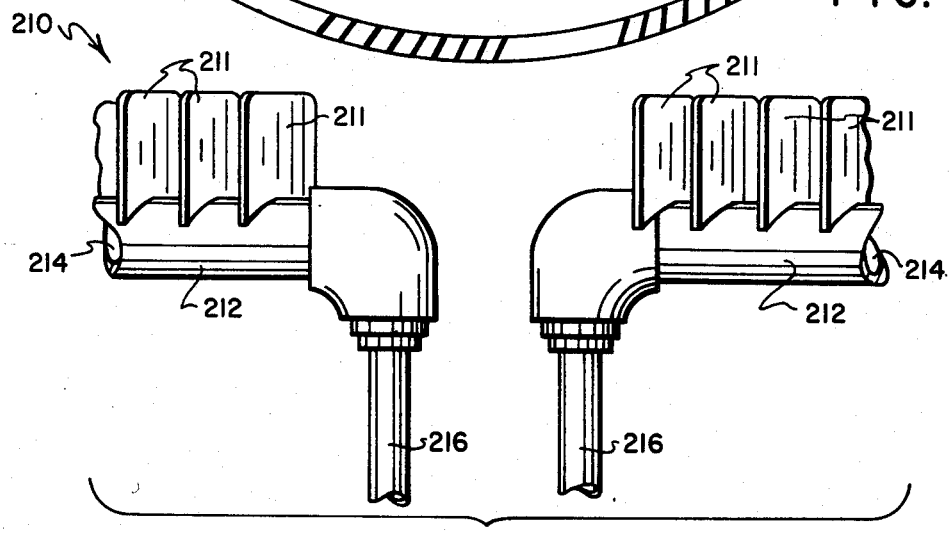

Referring to FIGS. 4, 5, 12 and 13, the charge support plate 53 defines a generally planar top wall 58 that rests atop the vane formations 60 and cooperates therewith to define the flow passages 52 that are curved (as viewed from above), shielded, horizontally-extending channels through which gases from the fan impeller 92 flow as they are directed rapdily outwardly. As is best seen in FIGS. 1, 2 and 13, the charge plate 53 has an annular dependency 61 that surrounds the central opening 55 and projects a short distance into the space that is centrally located among the inner ends of the vanes 60 of the center casting 51. The dependency 61 has a circumferentially extending shoulder 63 that engages the inner ends of at least some of the vanes 60 to interlock the charge support plate 53 and the center casting 51 and to prevent undesired relative movement thereof. The top wall 58 extends radially outwardly for a distance that is slightly farther than does the bottom wall 56 (i.e., the outer diameter of the top wall 58 is greater than the outer diameter of the bottom wall 56), whereby the top wall 58 serves to shield not only the inner cooling ring structure 210 but also radially inward portions of the outer cooling ring structure 110 (including the inner end regions of the curved passages 112 which are formed as grooves 111 in the outer ring structure 110). The top wall 58 of the charge support plate 53 serves to engage and support the lowermost coil 32 of the charge 30 of metal to be annealed.

Figure 4:
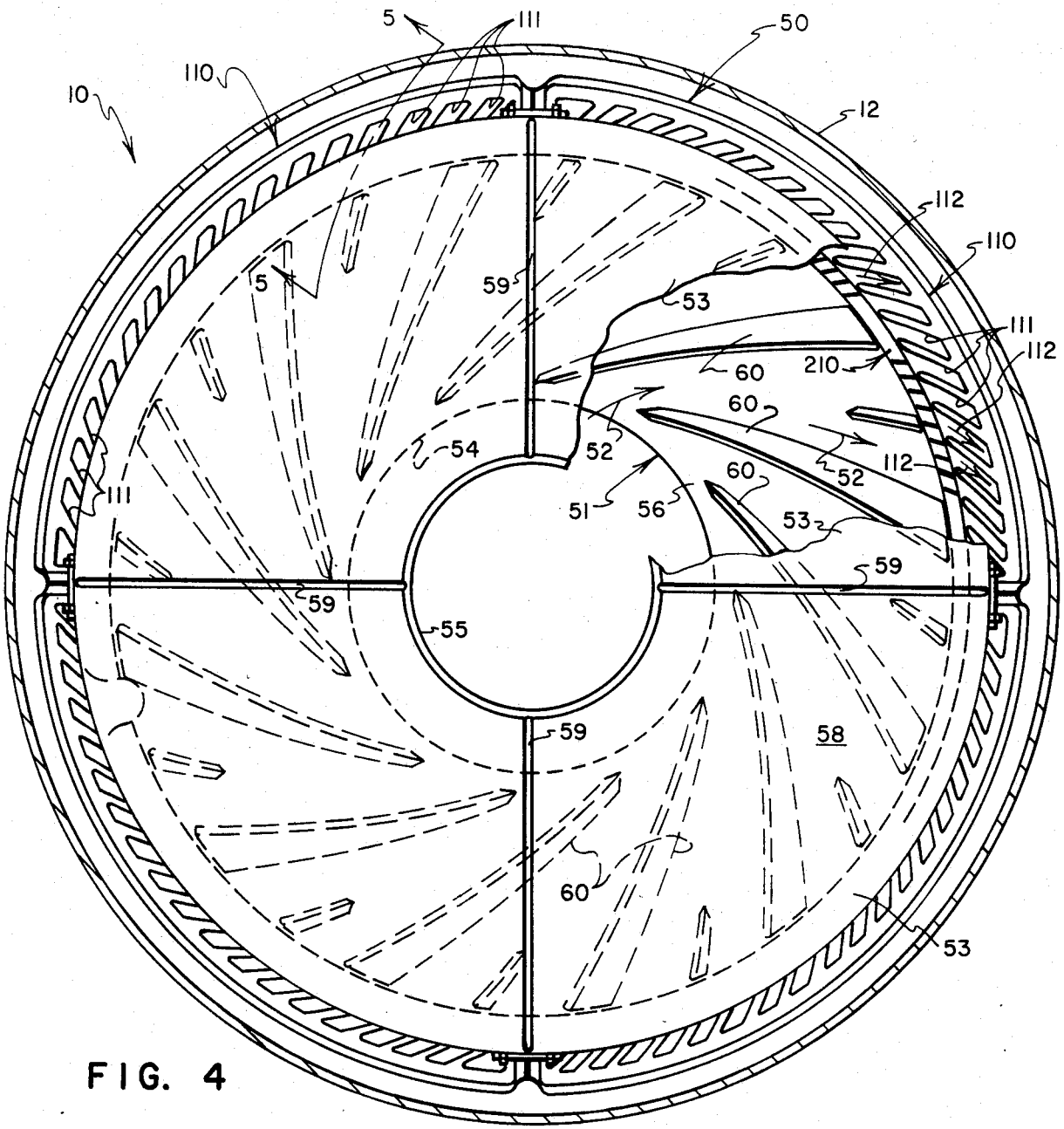
FIG. 4 is a sectional view, on an enlarged scale, as seen from a plane indicated by a line 4—4 in FIG. 1, with the plane of the section being selected to provide a top plan view of a diffuser base assembly that is employed in the apparatus of FIG. 1, wherein the diffuser base assembly includes as its major components a center casting, a charge support plate, and a pair of outer and inner cooling rings, but with a portion of the charge support plate being broken away to permit viewing of underlying (1) vanes of the center casting, (2) grooves of the outer cooling ring, and (3) fins of the inner cooling ring, with the view further including dotted lines that depict vane, groove and fin features of the center casting, the outer ring and the inner ring, respectively.
Figure 5:
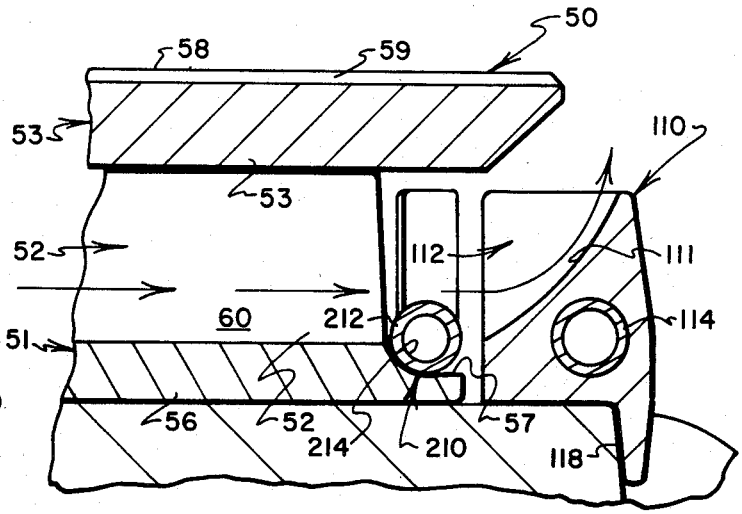
FIG. 5 is a somewhat schematic sectional view, on an enlarged scale, as seen from planes indicated generally by a curved line 5—5 in FIG. 4.
Figure 6:
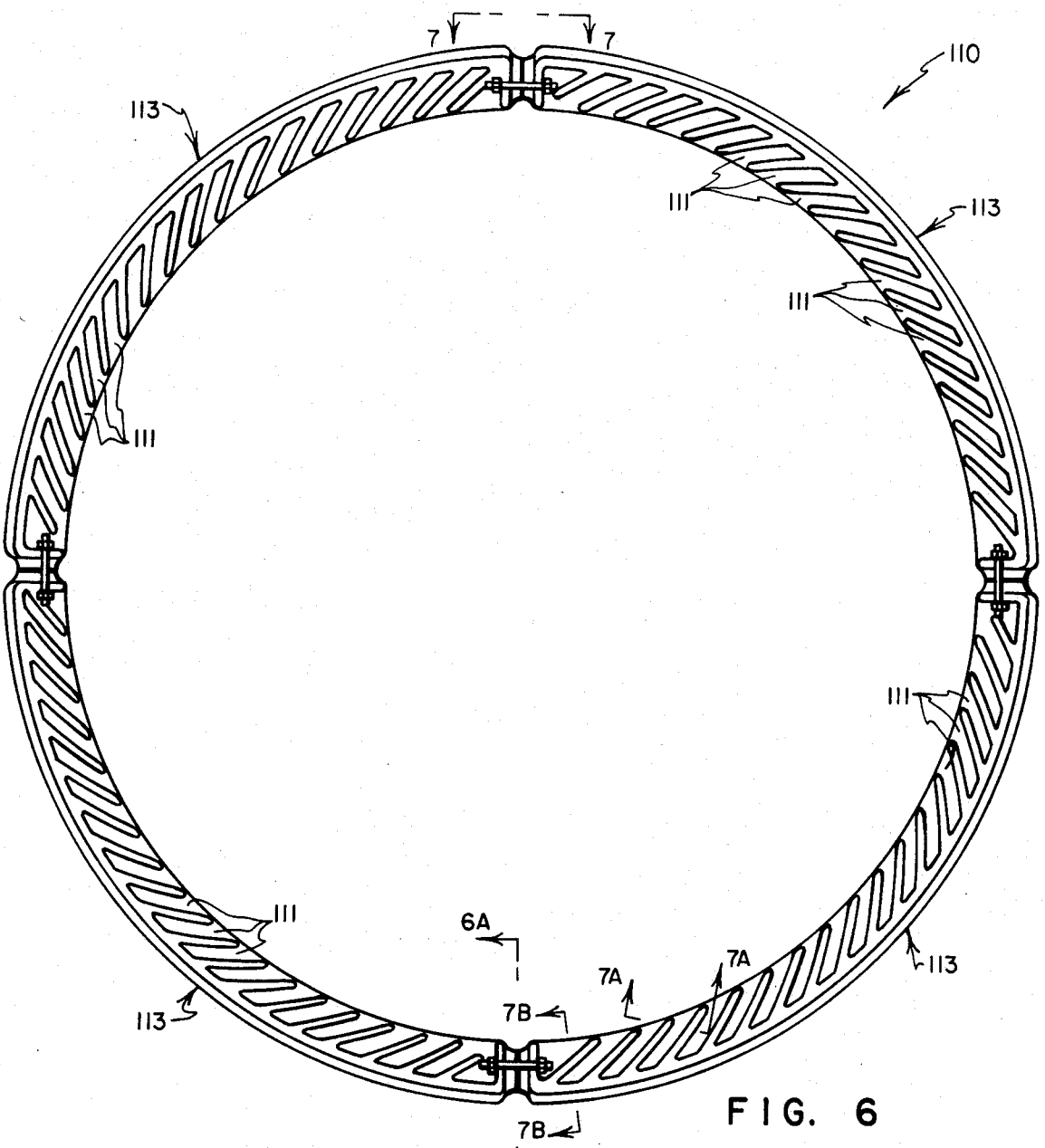
FIG. 6 is a top plan view of the bolted-together assembly of castings that forms the outer cooling ring of the diffuser base assembly.
Figure 6A:
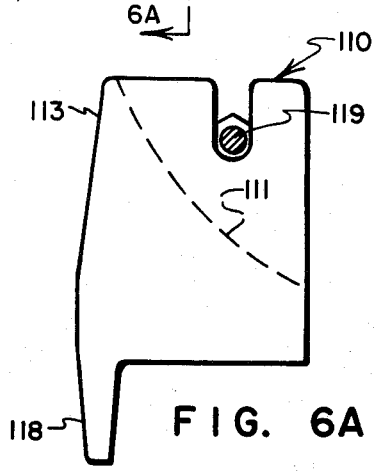
FIG. 6A is a sectional view, on an enlarged scale, as seen from a plane indicated by a line 6A—6A in FIG. 6.
Figure 7:
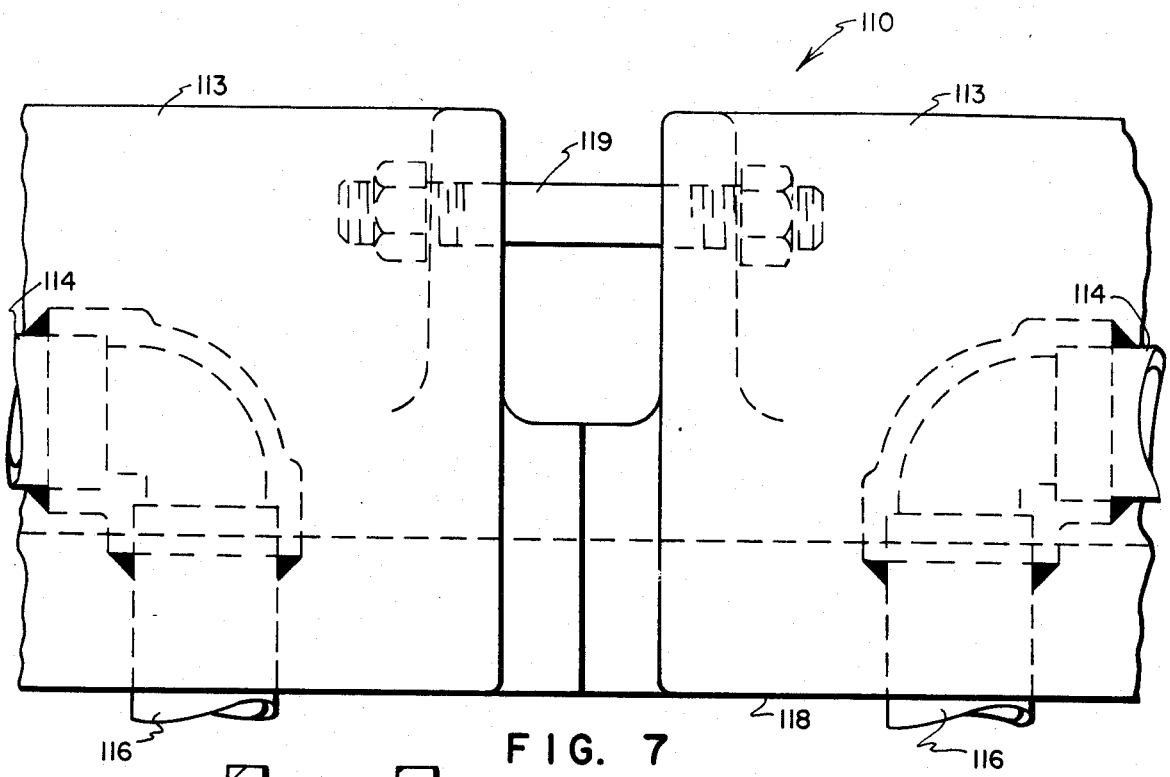
FIG. 7 is a side elevational view, on an enlarged scale, of portions of the outer cooling ring, as seen from a plane indicated by a line 7—7 in FIG. 6.
Figure 7A:
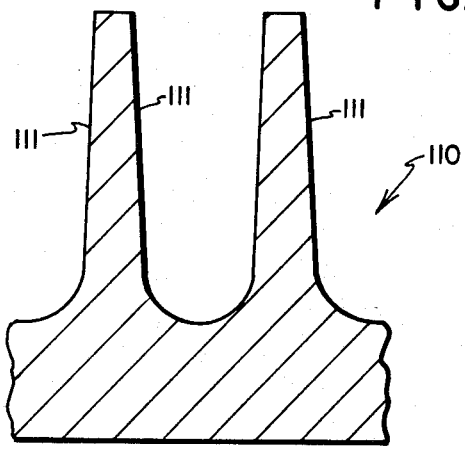
FIGS. 7A and 7B are sectional views, on an enlarged scale, as seen from planes indicated by lines 7A—7A and 7B—7B, respectively, in FIG. 6.
Figure 7B:
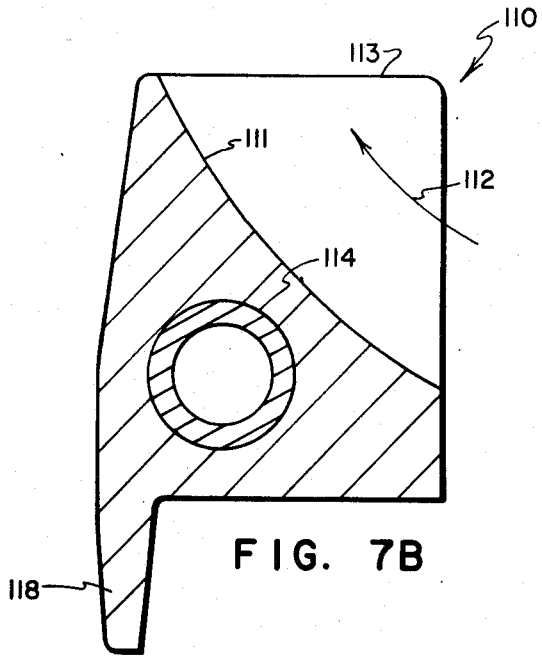

Referring to FIGS. 4–6, the outer cooling ring structure 110 extends perimetrically about portions of the center casting 51 and provides a spaced array of the grooves 111 (located at spaced locations extending along substantially the entire length of the ring 110). Referring to FIGS. 4, 5, 14 and 15, the inner ring structure 210 resides atop the ledge 57 such that it closely perimetrically surrounds the center casting 51 at a location that is spaced radially inwardly from the outer cooling ring 110. The inner cooling ring 210 has a plurality of fins 211 that are arranged in groups (typically of eight or nine relatively closely spaced fins), with the groups of fins 211 being spaced along the circumferential length of the underlying tube 212. The fins 211 cooperate with the vanes 60 of the center casting 51 and with the grooves 111 of the outer cooling ring structure 110 to duct gases that discharge horizontally from the passages 52 into the curved, upwardly turned passages 112. The vanes 60, the grooves 111, and the fins 211 cooperate to effect an advantageous directing of the flows of gases from the fan 90 so that these gas flows travel radially outwardly among the vanes 60 of the center casting 51, among the fins 211 of the inner ring 210, through the grooves 111 of the outer cooling ring 110, and then upwardly along substantially helical flow paths extending about the stack of coils 30, as is indicated in FIGS. 1 and 2 by the arrows 115.

As is best seen in FIGS. 2, 3, 5, 7 and 7B, the base-encircling outer cooling ring structure 110 is preferably formed as a bolted-together assembly of castings 113 that take the form of identical arcuate segments. Each of the castings 113 has embedded integrally within it a fluid cooling conduit 114. The conduits 114 have end portions 116 which depend for connection to a conventional fluid circulation unit (not shown). The cooling conduits 114 are utilized during the cooling part of an annealing cycle to diminish the temperature of the castings 113 of the outer ring 110 so that the outer ring 110 can likewise serve to reduce the temperature of the gases being circulated within the closed, controlled environment of the enclosure 12, as will be explained in greater detail.

As is best seen in FIGS. 2, 3A, 5, 14 and 15, the tube 212 of the inner ring structure 210 defines a cooling conduit 214 that has end portions 216 which depend for connection to a conventional fluid circulation unit (not shown). The conduit 214 and its heat conductive fins 211 are utilized during the cooling part of an annealing cycle to reduce the temperature of the gases being circulated within the closed, controlled environment of the enclosure 12, as will be explained in greater detail.

In accordance with the preferred practice of the present invention, the cooling conduits 114 that extend through the outer ring segments 113 are formed by pre-forming lengths of steel pipe to assume the desired configurations of the cooling conduits 114, filling the pipes with mold sand, positioning the pipes in sand molds which are configured to form the desired shapes of such nodular iron castings as are required to form the segments 113 of the outer ring structure 110 with the pipes positioned in the molds in the exact positions where it is desired to provide cooling conduits, and with end portions 116 of the pipes projecting beyond the mold cavities defined by the molds), whereafter molten iron is poured into the molds in the conventional manner to form the castings 113. After pouring and cooling, the castings 113 are removed from their molds, the sand is removed from the interior of the cooling conduits 114, and the cast segments 113 of the ring structure 110 are then connected by bolts 119, as shown in FIGS. 5, 6, 6A and 7, to form the completed outer ring structure 110.

If necessary to accomodate the diameter of a particular center casting 51, metal spacer blocks (not shown) may be installed between the bolted-together ends of the segments 113. By forming the outer cooling ring or "heat sink" 110 as cast segments that are bolted together, ring segments 113 having a given radius of curvature can be utilized, either with or without suitable space blocks (not shown) positioned between their bolted-together ends, to function about the periphery of center casting 51 of a range of outer diameters.

As is best seen in FIGS. 1, 2, 5, 6A, 7 and 7B, the outer ring structure 110 has, depending from its perimeter, a substantially continuous skirt 118 which extends into the upwardly opening groove 18 for engaging and sealing with the ceramic fiber refractory material 22 carried within the groove 18. The skirt 118 not only assists in preventing ambient air from entering the closed, controlled environment of the apparatus 10, but also serves to surround and shield from deterioration such portions of the furnace as underlie the ring structure 110.

Figure 8:
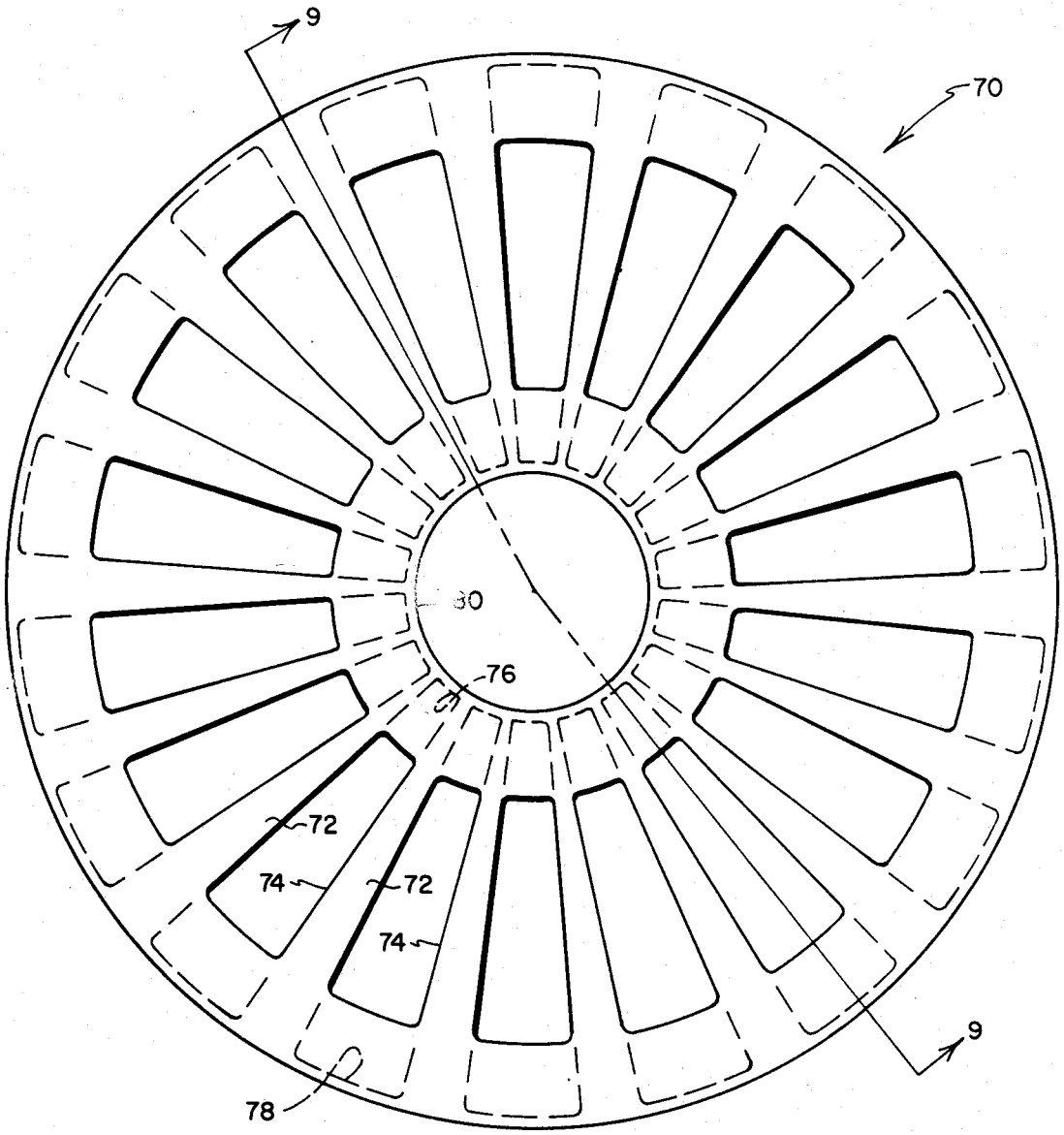
FIG. 8 is a top plan view of one of a plurality of convector plates that are utilized to separate vertically stacked coils of a charge of metal that is positioned for treatment within the confines of the apparatus of FIG. 1.
Figure 9:
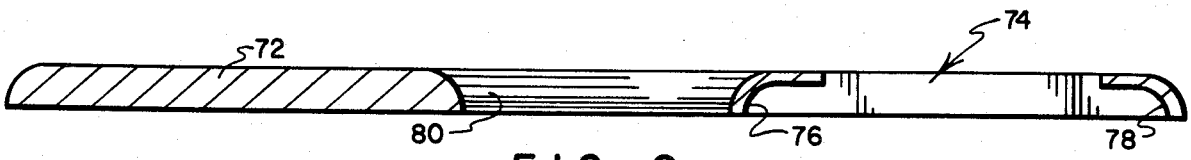
FIG. 9 is a sectional view as seen from planes indicated by a broken line 9—9 in FIG. 8.
Figure 10:
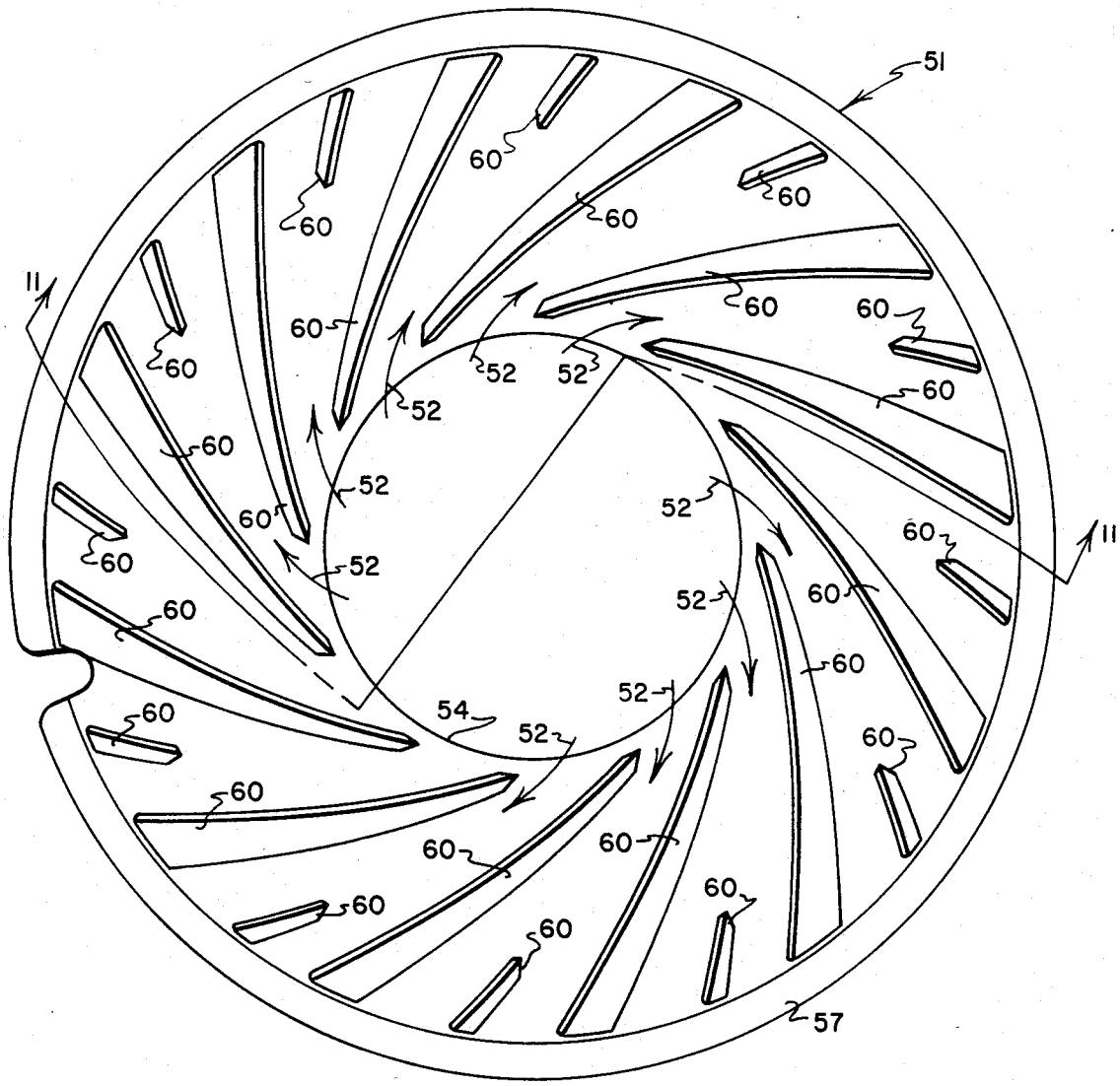
FIG. 10 is a top plan view of the center casting of the diffuser base assembly.
Figure 11:
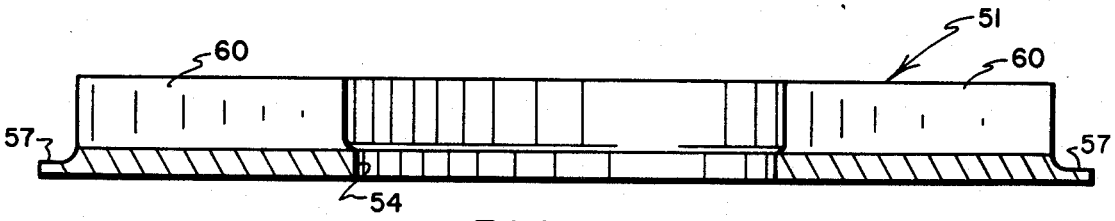
FIG. 11 is a sectional view as seen from planes indicated by a broken line 11—11 in FIG. 10.

Referring to FIGS. 8 and 9 in conjunction with FIG. 1, the convector plate 70 is shown as being formed from a one-piece cast structure, having a generally annular configuration. Spaced, radially-extending support ribs 72 extend between spaced, radially-extending open sectors 74. Curved inner and outer formations 76, 78 are provided at the inner and outer ends of the open sectors 74, respectively, for facilitating the flow of non-oxidizing gases between adjacent end regions of the stacked coils 32, 34. A central opening 80 defines a restricted flow orifice, the size of which is selected to assist in providing the desired type of gas flow circulation within the controlled, closed environment. The convector plate 70' is identical to the plate 70 and operates in a similar manner to facilitate the desired type of gas flow between the ends of the coils 34, 36 as well as downwardly through the stack 30 of coils 32, 34, 36. Features of the plate 70' which correspond to the described features of the plate 70 are indicated in FIG. 1 with "primed" numerals that are otherwise the same as the numerals used in conjunction with the plate 70.

An important aspect of the practice of the present invention resides in the use of the outer cooling ring 110 which can be thought of as a relatively rugged, very durably constructed "heat sink," in combination with the use of the much more lightly constructed inner cooling ring 210 that can be thought of as being a very efficient supplemental heat exchange device.

The nodular iron castings 113 from which the outer ring 110 is formed will withstand the rigors that are encountered as the ring 110 is employed to withdraw heat energy from hot circulating gases, and to transfer this heat energy to flows of cooling fluid that are circulated through the conduits 114. The durable character of the outer ring 110 enables it to be "turned on" (i.e., to have flows of cooling fluid initiated through its conduits 114) at relatively high temperatures of about 600°-900° F., a most preferred temperature being about 800° F. The outer cooling ring 110 acts as a "heat sink" that will, in a gradual and unobtrusive manner, serve to initiate the expedited withdrawal of heat energy from gases being circulated within the confines of the enclosure 12. The flows of cooling fluid through the conduits 114 of the outer ring 110 are continued until the temperature of the gases within the enclosure 12 has been reduced to a predetermined temperature, typically within the range of about 150°-300° F., a most preferred temperature being about 220° F., at which temperature the enclosure 12 can be opened without causing deleterious effects to the annealed coils 32, 34, 36 that comprise the charge 30.

The inner cooling ring 210 performs a very efficient transfer of heat energy from gases that are circulating within the enclosure to such cooling fluid as is circulated through the conduit 214. Preferably the inner ring 210 is "turned on" (i.e., has its coolant flow initiated) when gases within the enclosure 12 have reached a relatively lower temperature than is present when the coolant flows in the outer ring 110 are initiated, whereby the inner cooling ring 210 is subjected to a lesser "shock" than is incurred by the outer cooling ring 110. Typically the gas temperature at which coolant flow is initiated in the inner cooling ring 210 is within the range of about 400°-600° F., a most preferred temperature being about 500° F. The flow of cooling fluid through the conduit 214 of the inner ring 210 is continued until the temperature of the gases within the enclosure 12 has been reduced to a predetermined temperature, typically within the range of about 150°-300° F., a most preferred temperature being about 220° F., at which temperature the enclosure 12 can be opened without causing deleterious effects to the annealed coils 32, 34, 36 that comprise the charge 30.

While the inner ring 210 is shown as having a single conduit 214 that defines a single coolant flow path, this ring too can be formed as an assembly of segments (or otherwise) to provide a plurality of cooling conduits that define a plurality of coolant flow paths.

The fins 211 of the inner cooling ring 210 are oriented and structured to minimize aerodynamic obstruction, to aid in directing gas flows along desired paths, and to maximize heat exchange surface area. Preferably the fins 211 are formed from carbon steel but are copper coated or copper covered to maximize their heat exchange effectiveness. Because the inner ring 210 is subjected to a lesser thermal shock than the outer ring 110, the inner ring 210 can have its conduit 214 formed from stainless steel, to which the copper covered carbon steel fins 211 are welded.

The center casting 51 is preferably formed as a single member, using nodular cast iron. The charge support plate 53, however, is preferably formed from gray iron. While a charge support plate 53 formed from gray iron will almost always experience some radial cracking in the environment of an annealing furnace, gray iron is nonetheless preferred because it tends to retain its configuration, i.e., its top surface will tend to remain desirably planar. Other materials, such as nodular cast iron, tend not to crack and could be used in place of gray iron; however, gray iron is preferred inasmuch as other materials such as nodular iron may tend to warp or otherwise distort such that the top support surface they would provide to support the charge of metal 30 to be annealed could become undesirably non-planar.

Radial cracking of a charge support plate 53 can be partially controlled or at least confined by providing the charge support plate 53 with radially extending lines of weakness 59, as is best seen in FIGS. 4, 12 and 13. By this arrangement, if radial cracks do form, they will tend to form along the lines of weakness 59 thereby, at worst, tending to cause the charge support plate 53 to be divided along the lines of weakness 59 into two or more segments. The resulting segments are prevented from moving relative to the underlying central casting 51 by virtue of the extension of their depending formations 61 into the space located among the inner ends of the vanes 60 of the central casting 51, and by virtue of the abutting engagement of the shoulder 63 with inner ends of the vanes 60.

While features of the present invention (e.g., the provision of a center casting 51, a charge support plate 53, a pair of outer and inner cooling rings 110, 210, and convector plates 70, 70') have been described and illustrated as being used in combination with each other, it will be understood that these features may also be used independently one from another.

Although the invention has been described in its preferred form with a certain degree of particularity, it is understood that the present disclosure of the preferred form is only by way of example and that numerous changes in the details of construction and the combination and arrangement of parts may be resorted to without departing from the spirit and scope of the invention as hereinafter claimed. While orientation terms as "upwardly," "downwardly," "inwardly," "outwardly" and the like have been utilized in describing the invention, these terms should not be interpreted as being limiting. It is intended that the patent shall cover, by suitable expression in the appended claims, whatever features of patentable novelty exist in the invention disclosed.

What is claimed is:

1. A convection diffuser and charge support system for an annealing furnace, comprising:

(a) a generally annular base structure having inner and outer portions that define substantially concentric circles that are radially spaced one from the other, the base structure being formed form at least one base structure casting, the base structure defining a bottom wall, a top wall, a plurality of curved vane structures that extend substantially vertically between the top and bottom walls to define an array of curved, substantially horizontally extending flow passage means which underlie and are shielded from above by the top wall of the base structure, with the top and bottom walls of the base structure being of generally annular configuration when viewed from above, and with the curved horizontally extending flow passage means having inner and outer openings near the inner and outer portions of the base structure for ducting gas flows along curved, radially-outwardly-directed paths that extend from the inner openings toward the outer openings;

(b) the base structure defining upwardly facing means extending in a common horizontal plane for receiving and supporting a charge of material to be annealed, which charge is generally annular in configuration when viewed from above;

(c) a base-encircling outer ring means separately formed from at least one relatively massive outer ring structure casting, the outer ring means being configured and disposed to surround peripheral portions of the base structure, the outer ring means defining an array of curved, upwardly opening flow passage means which cooperate with the horizontally extending flow passage means of the base structure for ducting gases that discharge from the horizontally extending flow passage means and for ducting such discharged gases upwardly along generally helical paths of flow about a charge of material which is positioned atop the base structure for annealing;

(d) at least one outer ring cooling conduit within the at least one outer ring structure casting for ducting cooling fluid therethrough, the outer ring cooling conduit being disposed in the at least one outer ring structure casting in non-obstructing relation to the curved, upwardly opening flow passage means;

(e) a base-encircling inner ring means separately formed from at least one ring structure element and being configured and disposed to surround peripheral portions of the base structure at a location between the horizontally extending flow passage means of the base structure and the curved, upwardly opening flow passage means of the outer ring means, and having a plurality of fin elements projecting therefrom into paths of flow that are followed by gases discharging from the horizontally extending flow passage means toward the curved, upwardly opening flow passage means; and, (f) at least one inner ring cooling conduit connected to the fin elements for ducting cooling fluid therethrough to cool the fin elements.

2. The convection diffuser and charge support system of Claim 1 wherein the at least one casting of the base structure is formed from nodular cast iron.

3. The convection diffuser and charge support system of claim 1 wherein the at least one outer ring structure casting is formed from nodular cast iron.

4. The convection diffuser and charge support system of claim 1 wherein:

(a) the base structure includes a center casting that defines the bottom wall, and a charge support casting that defines the top wall;

(b) the top and bottom walls each have an inner diameter and an outer diameter;

(c) the outer diameter of the top wall is greater than that of the bottom wall, whereby the top wall serves to shield the outer openings of the horizontally-extending flow passage means; and, (d) the top wall overlies portions of the outer ring means and shields radially inward portions of the curved, upwardly opening flow passage means.

5. The convection diffuser and charge support system of claim 4 wherein the center casting is formed of nodular cast iron.

6. The convection diffuser and charge support system of Claim 4 wherein the charge support casting is formed from gray cast iron, the charge support casting has a top wall that is substantially planar for supporting a charge of metal to be annealed, and radially extending lines of weakness are provided in the charge support casting to provide for radial cracking of the charge support casting.

7. The convection diffuser and charge support system of claim 1 wherein the outer ring means has a substantially continuous depending skirt formed integrally with the at least one outer ring structure casting and projecting downwardly from its periphery.

8. The convection diffuser and charge support system of claim 1 additionally including annular convector plate means for insertion between adjacent end regions of a pair of stacked coils comprising a charge that is to be annealed, the convector plate means including an annular convector plate structure formed as at least one casting, and having an alternating array of radially extending ribs and open sectors for supporting one of the coils atop the other while defining flow paths for circulation of gases therebetween.

9. The convection diffuser and charge support system of claim 1 wherein the outer ring means is formed from a pluality of ring structure castings, and each of the ring structure castings has a separate cast-in-situ cooling conduit extending therethrough.

10. The convection diffuser and charge support system of claim 1 wherein the bottom wall of the base structure has a circumferentially extending projection, and the inner cooling ring means is supported by said projection.

11. The convection diffuser and charge support system of claim 1 wherein the fin elements of the inner cooling ring means have copper on their exposed surfaces.

12. The convection diffuser and charge support system of claim 1 wherein the fin elements are copper covered carbon steel, and are welded to the inner ring cooling conduit.

13. A convection diffuser and charge support system of claim 1 wherein the outer ring structure casting has a cast-in-situ cooling conduit for cooling the flow of gases passing by the base structure, with the cast-in-situ cooling conduit having been formed by a process that includes the steps of:

(a) preparing a sand mold cavity defining exterior surfaces of the outer ring structure casting to be formed;

(b) performing a steel pipe with a desired shape for a cooling conduit to be provided in the outer ring structure casting, and having terminal extensions which project from the mold cavity such that the terminal portions will project from the outer ring structure casting after it has been cast;

(c) substantially filling the preformed pipe with sand;

(d) pouring molten metal into the mold cavity to fill the mold cavity;

(e) congealing the molded ring structure casting; and, (f) removing the sand from the preformed pipe.

* * * * *